United States Patent [19]

Yeates

[11] 4,211,280

[45] Jul. 8, 1980

[54] DOWNHOLE SURGE TOOLS, METHOD AND APPARATUS

[76] Inventor: Robert D. Yeates, 3217 High Sky Dr., Midland, Tex. 79703

[21] Appl. No.: 39,156

[22] Filed: May 15, 1979

Related U.S. Application Data

[62] Division of Ser. No. 947,049, Sep. 29, 1978, Pat. No. 4,182,419.

[51] Int. Cl.[2] ..... E21B 21/00

[52] U.S. Cl. ..... 166/311; 166/299

[58] Field of Search ..... 166/299, 311, 317, 318, 166/125, 192, 135

[56] References Cited

U.S. PATENT DOCUMENTS

| | | | |
|---|---|---|---|
| 1,835,444 | 12/1931 | Taylor | 166/318 X |
| 2,756,828 | 7/1956 | Delly | 166/317 X |
| 2,776,015 | 1/1957 | Beilestein | 166/125 X |
| 3,003,565 | 10/1961 | Courtney | 166/152 |
| 3,095,040 | 6/1963 | Bramlett | 166/192 X |
| 3,353,609 | 11/1967 | Jensen | 166/317 |
| 3,812,911 | 5/1974 | Vann | 166/135 |
| 3,831,680 | 8/1974 | Edwards et al. | 166/311 |

*Primary Examiner*—James A. Leppink
*Assistant Examiner*—Richard E. Favreau
*Attorney, Agent, or Firm*—J. Gibson Semmes

[57] ABSTRACT

Downhole method and apparatus for efficient well completions wherein natural earth energy is utilized by the exploitation of a maximum pressure differential into a given well bore. The method and tools of the apparatus function to back surge the well, enhancing reservoir communication, saving time and reducing costs. Tools of the apparatus include a tubular nipple, a surge plug inserted operationally into the nipple, and an optional catcher sub connected thereto. The entire tool assembly is production actuated by dropping a recoverable bar of sufficient weight to overcome that buoyant force which seals the plug within the nipple. The essence of invention resides in the economy of time and material.

2 Claims, 4 Drawing Figures

DOWNHOLE SURGE TOOLS, METHOD AND APPARATUS

This application is a division of Ser. N0. 947,049, filed Sept. 29, 1978; now U.S. Pat. No. 4,182,419.

SUMMARY OF THE INVENTION

The invention has as its objectives to provide the means whereby an oil or gas well can be completed efficiently, utilizing the natural reservoir energy to bring the well in, while simultaneously expelling damaging fluids and solids that may have invaded the pay zone during drilling, cementing and perforating operations. The method allows for the well to be perforated for maximum reservoir penetration, in acid, removing the guns, attaching the apparatus to the production tubing, then floating the production tubing into the well dry. A retrievable production packer is run above the surge tool assembly and the well completed. A recoverable bar is then dropped down the tubing to knock out a unique surge plug from a unique steel nipple. The bar and plug fall away, leaving the tubing fully open, with no internal restrictions. A split second after impact, the hydrostatic pressure below the packer is relieved, which in turn releases the potential reservoir energy. The natural reservoir pressure is thus applied across each casing perforation to expel perforating damage, acid, cement and drilling fluid invasion. A dynamic flow then occurs up the dry tubing.

This knock-out plug surging method is essentially fail-safe, both with regard to successfully running the tubing dry, and being able to expel the plug. The surge plug and nipple can be pressure tested before use. Hydrostatic testing of the tubing can be accomplished while completing the well. The surge tools cannot open prematurely, while being lowered into a well. Surging, or opening the tools can be accomplished only by knocking out the plug with an appropriately weighted object applied from above, or by pumping fluid down the tubing at a nominal pressure. After the plug is ejected by impact of the bar, both bar and plug fall safely below the production apertures of a catcher sub and remain therein. Where the catcher sub is not utilized, the bar falls into the well casing. The unique construction of the plug prevents the high velocity flow stream of the surge from jamming the plug back into the nipple.

Adoption of this method and apparatus is desirable, but not limited to, wells having fluid sensitive formations. Other benefits from the use of this method include: reduced completion time and expense; increase assurance of zone isolation from proximal water and lower breakdown pressures when subsequently stimulating. Lower stimulation pressures reduce the risk of hydraulic fracturing out of zone. This well-surging method is also adaptable to clean-up of existing wells and to more successful casing recoveries in abandonment procedures. The method is not generally suited to wells known to have low permeability or low pressure in the pay zone.

DESCRIPTION OF THE PRIOR ART

The best of the known prior art is represented by the patents to Bramlett, U.S. Pat. No. 3,095,040; to Courtney, U.S. Pat. No. 3,003,565; and to Bielstein, U.S. Pat. 2,776,015, as well as to Vann U.S. Pat. No. 3,812,911.

See also New Backsurging Cleans Even Old Perforations by Emmett F. Briezer—WORLD OIL, June 1978.

Bramlett's apparatus requires a breakable relief plug positioned above a bevelled, full diameter sealing plug. In Bramlett, the bevelled plug is secured in place by hydrostatic pressure applied across the full cross-sectional area of the plug, necessitating the use of the breakable plug to relieve the high sealing pressure due to the hydrostatic effect. In contrast, the surge plug of this invention is secured in place by hydrostatic sealing pressure acting across the significantly smaller cross-sectional area of the inner diameter of the nipple, thus eliminating the need for initial pressure relief. As a result of the smaller hydrostatic effect, and the uniqueness of the present plug and nipple construction, the pressure is relieved simultaneously with the plug's being ejected by the weighted bar. This occurs as a result of the water flowing upward along the plug, through the courses and relief groove therein, and into the large nipple bore. The Bramlett invention, in further contrast, was developed for preparing a well for through tubing perforating, whereas the device of the present invention is adapted to wells which have already been perforated by guns which shoot deeper into the rock, resulting in better well completions. The present invention is thus adapted for applications where perforation at high differential pressure is desirable. Additionally, in operation under the present method, one may employ the catcher sub, a feature not described or considered in the Bramlett concept. It is further considered impossible for use on Bramlett's tool as described in U.S. Pat. No. 3,095,040.

DESCRIPTION OF THE PREFERRED EMBODIMENTS

Figure 1:
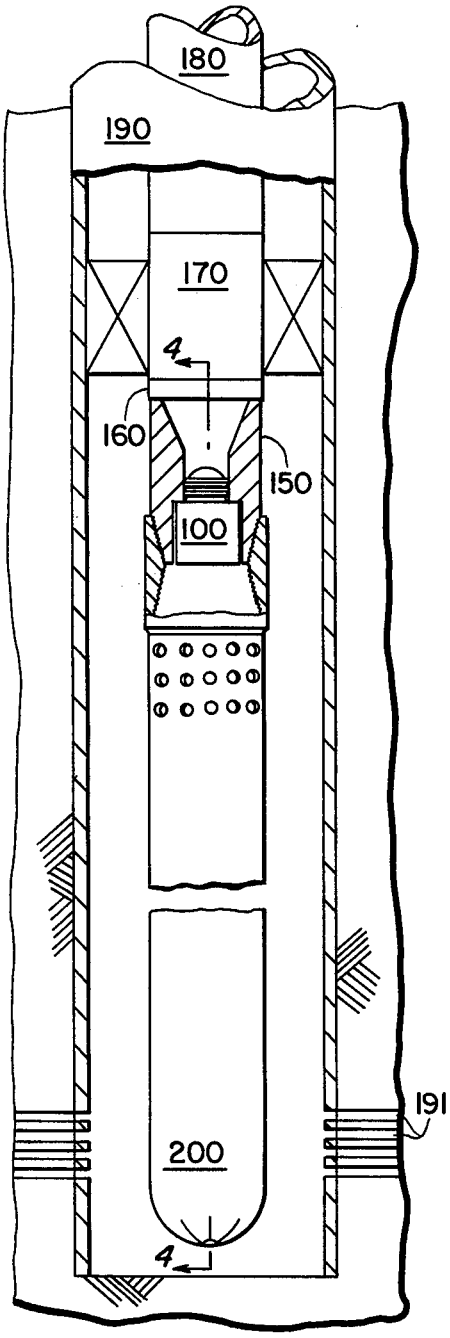
FIG. 1 is a view of invention in side elevation showing the disposition of the assembly in the bottom of a well.

Referring to the drawings, the basic elements comprising the assembly include the surge plug 100 and its associated nipple 150, together with the optionally useable catcher sub 200. Although the plug may be formed of a mild steel, it is preferably fabricated from high strength aluminum, owing to desirable solubility in acids. The plug is circular in horizontal cross-section, having a rounded impact surface 110 beneath which are plural annular grooves 112 for seating O-rings 114. As indicated, the diameter of the plug at the top is slightly less than the inside diameter of the central portion of the nipple 150, the O-rings providing a secure hydrostatic seal between the plug and the nipple while the tools are being positioned in casing 190. It is desirable to have two in-line O-ring seals so that the plug will be balanced, irrespective of distortional hydrostatic forces applied by back surging pressures. Immediately beneath the O-ring grooves is the relief groove 116. This has connection with the courses 122, four of which are disposed at quadrant positions of the plug. The courses terminate at 124 adjacent the abutment or shelf 126. As mentioned, the plug has a smaller upper diameter, commencing with the bottom ofthe rounded impact surface 110, this diameter extending one-third the overall length of the plug. The lower two-thirds of the plug are, as shown, of greater diameter. The courses 122 are cut along the length of this lower two-thirds of the plug from the flat, circular bottom thereof upward, connecting with the relief groove 116 which is cut around the plug's smaller circumference. Bores 128 are drilled axially upwardly into the plug from the flat bottom to a horizontal center line of the relief groove 116. These bores 128 are preferably five in number, four being disposed at positions which are oriented at 45°, relative to the location of the courses 122 and one being disposed axially at the center of the plug.

Figure 2:
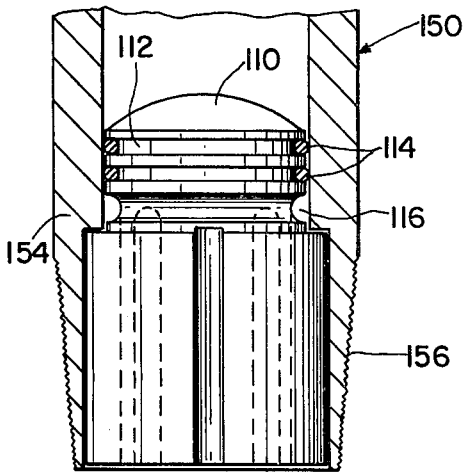
FIG. 2 is an enlarged side elevation of the nipple, the attached nipple being in vertical section.

Nipple 150 is provided with a long interior top portion 152 which is tapered outwardly, the nipple having a threaded outer portion which is adapted to engage the coupling 160. As shown, the long tapered nipple bore 152 is adapted to guide a conventional drop bar, not shown, to the dome of the plug. Adjacent the lower end of the nipple 150 is an abutment or shoulder 154 for continuously seating the corresponding shelf 126 of the plug thereon; to fix its upward position as shown in FIG. 2. Also at the bottom of the nipple 150 is a thread 156 which corresponds to the connected coupling 212 of an optionally usable catcher sub 200.

As the plug and nipple assembly are lowered below the existing surface of the liquid in the well casing 190, hydrostatic forces will act upward through the courses 122 of the plug inside the lower nipple bore and up to the lowest O-ring sealer 114, the magnitude of the hydrostatic forces naturally increasing with the depth of submergence of the tool. These upward forces are applied to the smaller horizontal cross-sectional area of the nipple tending to literally pull or lift the plug upward against the restricting shoulder 154 of the nipple bore, the O-ring seals 114 preventing well fluids from entering the tubing 180 prematurely. See FIG. 1.

Figure 3:
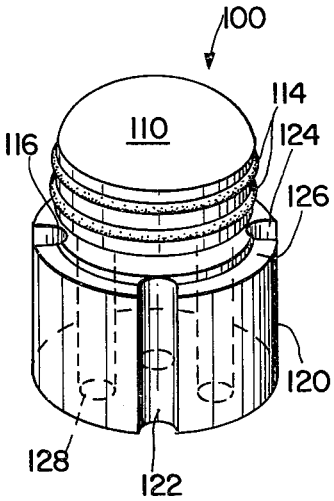
FIG. 3 is a view in perspective of the surge plug.
Figure 4:
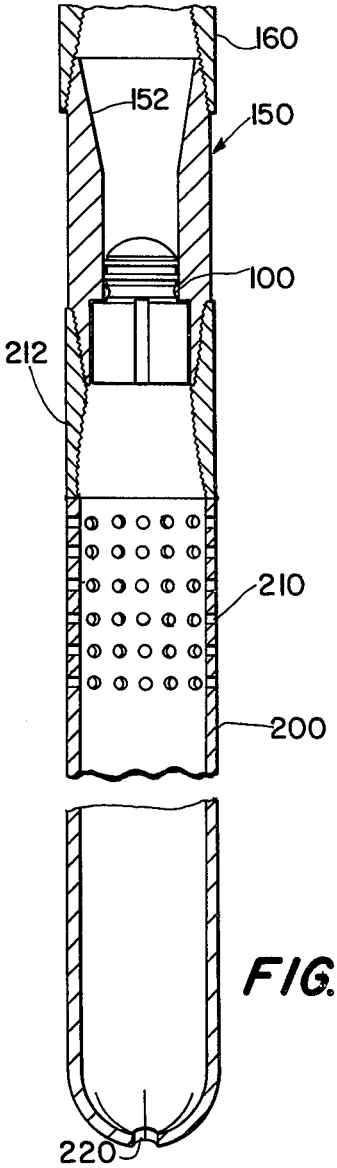
FIG. 4 is a vertical sectional view of the entire nipple-plug-catcher sub assembly taken along the lines 4—4 of FIG. 1.

As earlier indicated, the catcher sub 200 and its attachment to the plug-nipple assembly is optional; for example, where it may be desirable to pull the tubing 180 after surging. As best shown in FIG. 4, the catcher sub 200 is adapted to attachment to the lower end of the surge nipple 150 by means of the coupling 212, said coupling engaging the corresponding threaded portion 156 of the nipple. The catcher sub is provided with production apertures 210 and a hydraulic pressure relief port 220 at the bottom. If, as in operating shallow wells, the catcher sub may not be desirable, the drop bar may be recovered, if its removal is necessary, by wire line and appropriate fishing tool. In such instances, and because of the construction material and design, the plug is readily drillable or destructible in time by acid or other corrosive well fluids. Such is the utility of the bores 128, reference FIG. 3. In the operation of deeper wells, wherein a given surge may result in a high velocity fluid flow, the plug is so constructed that as the drop bar falls below the plug, reentry and jamming of the nipple by the plug, due to the flow stream will not occur. Where the catcher sub is utilized in such wells, the drop bar shoves the lightweight, asymmetrical plug past the production apertures 210 of the catcher sub 200 to a final state of rest in the sub. As the tubing 180 is removed from the well, the bar and plug 100 are thereby recovered and all tools are reusable.

The downhole surge tool assembly herein may include connecting the catcher sub to the nipple as indicated in FIG. 4, after the plug has been inserted therein. In operation, these interconnected and coactive tools are then lowered into a well such as may have been perforated as at 191, in acid, by a deeply penetrating gun. Above the surge tool assembly comprising the elements 100, 150 and 200, the production packer 170, other production tools and production tubing 180 are interconnected, all while hydrostatic testing is being undertaken, if testing is desirable. The tubing 180 is floated into the well dry, the packer is set above the casing perforations 191 and the well is then completed. The tubing outlet may then be connected to a secure flow line before surging the well. Completion surging is accomplished by dropping a bar of appropriate size and weight such that it will fall through the tubing and strike the plug 100 with a force which is sufficient to eject the plug. The conventional retrievable bar, not shown, must have an adequate weight which, upon striking the plug, develops sufficient kinetic energy to overcome the work necessary to expel the plug from the nipple. Where the use of a drop bar becomes undesirable, the plug may be ejected by pumping a suitable volume of fluid down the tubing at a pressure which is sufficient to balance the hydrostatic head at the plug and to overcome the friction of the O-ring seals. When the plug has been ejected, the tubing is fully opened, having a diameter which is no smaller than an appropriately sized API seating nipple.

I claim:

1. For use with a well having a bore, a casing, and production perforations, a method of well completion comprising the steps of:

(A) installing, on the downhole end of production tubing, below a production packer, a tubular nipple, said nipple having an ejectable non-frangible surge plug sealably disposed in the lower end thereof;

(B) lowering the assembly of step (A) into the well bore, positioning said surge plug above the perforations;

(C) positioning and setting the packer above said assembly;

(D) drop bar ejecting said surge plug to provide a substantially instantaneous full opening at the bottom of the tubing, whereby a maximum pressure differential into the well bore is substantially instantaneously created, whereby fluid and particulate matter from the well bore and formation surge inwardly and upwardly through the tubing.

2. A method according to claim 1, including the step of:

(E) catching and retaining the ejected surge plug and drop bar.

* * * * *